US008057220B2

(12) United States Patent
Bretz

(10) Patent No.: US 8,057,220 B2
(45) Date of Patent: Nov. 15, 2011

(54) AIR ASSISTED SIMPLEX FUEL NOZZLE

(75) Inventor: David H. Bretz, West Des Moines, IA (US)

(73) Assignee: Delavan Inc, West Des Moines, IA (US)

( * ) Notice: Subject to any disclaimer, the term of this patent is extended or adjusted under 35 U.S.C. 154(b) by 761 days.

(21) Appl. No.: 12/012,336

(22) Filed: Feb. 1, 2008

(65) Prior Publication Data

US 2009/0197214 A1 Aug. 6, 2009

(51) Int. Cl.
*F23D 11/00* (2006.01)
*B05B 7/10* (2006.01)

(52) U.S. Cl. ..... 431/159; 431/175; 239/406

(58) Field of Classification Search ..... 239/406, 239/405, 418, 416.5, 404, 403, 358; 431/159, 431/175, 176; 60/39.06, 740
See application file for complete search history.

(56) References Cited

U.S. PATENT DOCUMENTS

| | | | | |
|---|---|---|---|---|
| 2,551,276 | A * | 5/1951 | McMahan | 239/400 |
| 2,854,285 | A * | 9/1958 | Barton | 239/430 |
| 3,022,954 | A | 2/1962 | Davies et al. | |
| 3,217,986 | A * | 11/1965 | Walsh et al. | 239/403 |
| 3,790,086 | A * | 2/1974 | Masai | 239/406 |
| 3,890,233 | A | 6/1975 | Gischel | |
| 5,115,634 | A | 5/1992 | Bretz et al. | |
| 5,224,333 | A * | 7/1993 | Bretz et al. | 60/740 |
| 6,382,959 | B2 | 5/2002 | Turk et al. | |
| 6,688,534 | B2 | 2/2004 | Bretz | |
| 6,920,749 | B2 | 7/2005 | Mansour et al. | |
| 7,273,187 | B2 * | 9/2007 | Kjeldal et al. | 239/112 |
| 2004/0056124 | A1 | 3/2004 | Haruch | |

FOREIGN PATENT DOCUMENTS

| | | |
|---|---|---|
| WO | WO 95/09053 | 4/1995 |
| WO | WO-2004056488 | 7/2004 |

OTHER PUBLICATIONS

European Search Report dated Mar. 27, 2009 for EP09001101.
Siphon Type SNA™ Air Atomizing Nozzles, www.delavaninc.com, Goodrich Corporation 2004-2005.
AIRO™ Air Atomizing Nozzles, www.delavaninc.com, Goodrich Corporation 2004-2005.
European Examination Report, dated Nov. 8, 2010 for European Patent Application No. 09001101.6.

* cited by examiner

*Primary Examiner* — Kenneth Rinehart
*Assistant Examiner* — Chuka C Ndubizu
(74) *Attorney, Agent, or Firm* — Scott D. Wofsy; Edwards Angell Palmer & Dodge LLP

(57) ABSTRACT

Disclosed is an air-assisted simplex spray nozzle assembly for a fuel burner that includes, inter alia, a nozzle body that has opposed upstream and downstream ends, wherein the downstream end of the nozzle body defines a fuel outlet, an adapter member that is engaged with the upstream end of the nozzle body and defines concentrically positioned air and fuel inlets for the nozzle assembly and an air cap that is positioned over the downstream end of the nozzle body. The nozzle assembly further includes a fuel circuit and a first air circuit. The fuel circuit directs fuel from a fuel pump toward the fuel outlet of the nozzle body. The fuel circuit extends from the fuel inlet of the adapter member through the nozzle body to the fuel outlet. The first air circuit directs assist air towards the fuel exiting from the fuel outlet. The first air circuit extends from the air inlet of the adapter member, through a gap defined between the air cap and the nozzle body and merges with the fuel emitted from the fuel outlet of the nozzle body. In certain embodiments, the assist air is provided to the first air circuit by an auxiliary pump.

20 Claims, 7 Drawing Sheets

AIR ASSISTED SIMPLEX FUEL NOZZLE

BACKGROUND OF THE INVENTION

1. Field of the Invention

The present invention is directed to low flow fuel nozzles for use in burners, such as oil burners, and more particularly, to an air assisted simplex fuel nozzle that is adapted for fuel modulation and uses auxiliary assist air to atomize the fuel.

2. Background of the Related Art

Conventional burners used in home heating applications generally include a fuel supply conduit connected at one end to a fuel supply pump and terminating at the other end at a fuel nozzle where the fuel is dispensed as an oil spray. The spray nozzle functions to mix the fuel with air that has been delivered by a motor powered blower. A burner-mounted ignition system is connected to an ignition apparatus that is located adjacent to the fuel nozzle near the exit where it ignites the atomized fuel-air mixture.

Typically, home heating applications require low flow rates (approximately 0.5 gph to 1.0 gph) of finely atomized fuel. Moreover, extremely low fuel flow rates (less than 0.5 gph) are desirable in applications where the volume of air to be heated is small, such as in a trailer home or small office.

Several known techniques exist for atomizing fuel. One conventional method of atomizing fuel is "pressure atomization," whereby high velocity fuel is injected into relatively low velocity air. The interaction between the fuel and air shreds the fuel into fine droplets and subsequently greatly increases the fuel's surface area. The fine droplets and large surface area-to-volume ratio enhance chemical reaction rates that are beneficial to many processes. The disadvantage of using pressure atomization for low fuel flow rates is that the fluid passage size has to be very small to generate the hydraulic pressure required for atomization. Small fluid passage sizes are difficult to manufacture and are detrimental to product life due to a propensity to plug the fuel passage with contamination. When the passage size is maintained at some minimal value that is deemed acceptable for contamination resistance, the resultant hydraulic pressure associated with such a reduced fueling rate is so low that atomization is poor or nonexistent and fuel distribution is substandard.

An alternative method for atomizing fuel is to inject low velocity fuel into a relatively high velocity air stream. This method is generally referred to as "air blast atomization". This method overcomes the minimum fluid passage size and low fuel pressure issues associated with "pressure atomization" as long as there is sufficient kinetic energy in the atomizing air stream to properly break up the fuel. In certain applications, the air stream does not have sufficient energy for atomization or there are operating modes where the air stream has limited energy for atomizing the fuel. When the atomizing air energy is low or insufficient, the result is the same as that of the low flow pressure atomizer; poor or nonexistent atomization and poor fuel distribution.

For applications where the required fuel flow rate is too low for effective pressure atomization and where there are no air blast atomizing air streams with sufficient energy across the application's entire operating range; an air assist system can be used. Air assist atomizers typically utilize a relatively high-pressure, high velocity air from an external source to augment the atomization process. Because the air assist atomizer uses an external source (e.g., a compressor), it is important to keep the air flow rate to a minimum in order to minimize the cost of the auxiliary air system. Thus, air assist atomizers are characterized by their use of a relatively small quantity of very high velocity air. The use of kinetic energy from the auxiliary air circuit to break up the fuel droplets provides very good atomization and fuel distribution at very low fuel flow rates. The low fuel pressure and fuel velocities associated with low fuel flow rates are not detrimental in an air assisted atomizer; in fact, a low fuel exit velocity as compared to a high air assist velocity provides the greatest relative velocity between the two fluids and promotes good atomization.

A siphon nozzle, shown in FIGS. 1*a* and 1*b*, is an example of a known method for using assist air to atomize the fuel. The siphon nozzle routes air from an external source and directs it towards a fuel delivery feature which is normally a simple orifice. The air circuit is configured to create a low pressure region at the fuel delivery outlet which draws the fuel into the air steam. The amount of fuel drawn into the air is related to the lift height of the fuel above a fuel reservoir and the amount of air moving through the nozzle. While siphoning is a very effective method of atomizing fuel it has a limited range of fuel modulation. In a siphon nozzle, if the fuel supply is pressurized to increase the fuel flow rate then the simple orifice creates a plain jet of fuel which inhibits fuel atomization. Also when a simple orifice is used that does not impart a swirl or spin to the fuel, the resultant spray pattern tends to be a solid cone which may or may not be a match for a particular application.

Another example of a prior art device that uses assist air to atomize the fuel is an "Airo" nozzle, shown in FIGS. 2*a* and 2*b*. This concept uses internal mixing of pressurized fuel and air to atomize the fuel. With internal mix atomizers there can be interactions between the fuel circuit and air circuit. For instance, a change in the fuel flow rate may have an effect on the air flow rate or an increase in air pressure may change the fuel spray angle. The "Airo" concept will atomize very low flow rates of fuel, but because of the interactions between the fuel and air circuits, may require more complex controls to properly modulate the fuel and air circuits.

Therefore, there is a need for a low flow fuel nozzle for use in burners, such as oil burners that is easily modulated and uses assist air to atomize the fuel.

SUMMARY OF THE INVENTION

The present invention is directed to an air-assisted simplex spray nozzle assembly for a fuel burner that includes, inter alia, a nozzle body that has opposed upstream and downstream ends, wherein the downstream end of the nozzle body defines a fuel outlet, an adapter member that is engaged with the upstream end of the nozzle body and defines concentrically positioned air and fuel inlets for the nozzle assembly and an air cap that is positioned over the downstream end of the nozzle body. The nozzle assembly further includes a fuel circuit and a first air circuit. The fuel circuit directs fuel from a fuel pump toward the fuel outlet of the nozzle body. The fuel circuit extends from the fuel inlet of the adapter member through the nozzle body to the fuel outlet. The first air circuit directs assist air towards the fuel exiting from the fuel outlet. The first air circuit extends from the air inlet of the adapter member, through a gap defined between the air cap and the nozzle body and merges with the fuel emitted from the fuel outlet of the nozzle body. In certain embodiments, the assist air is provided to the first air circuit by a pump.

The nozzle assembly of the present invention preferably includes a fuel distributor disposed within an interior chamber defined by the nozzle body for receiving fuel from the fuel inlet of the adapter member and directing the fuel radially outward. It is also envisioned that the nozzle assembly can utilize an orifice disc that is disposed within the interior chamber of the nozzle body downstream of the fuel distributor. In such constructions, the fuel circuit extends through a gap formed between the fuel distributor and the orifice disc which terminates in a spin chamber. Preferably, the fuel distributor has a plurality of slots formed in its downstream end that are adapted and configured for imparting a swirl to the fuel traversing the fuel circuit.

In a preferred embodiment, the adapter member includes a plurality of flow ports that are in fluid communication with the air inlet and extend at an angle with respect to a central axis for the nozzle assembly to the exterior of the adapter member. Still further, it is envisioned that the nozzle body can include a plurality of flow ports that are in fluid communication with corresponding flow ports of the adapter member and direct the assist air to a gap defined between the air cap and nozzle body.

It is further envisioned that the downstream surface of the nozzle body can include means for imparting a swirling motion to the assist air passing through the gap defined between the air cap and the nozzle body.

In certain embodiments of the present invention the nozzle assembly can also include a first and second tube members that are engaged with the adapter member. It is envisioned that the first tube member is adapted for supplying auxiliary assist air to the air inlet of the adapter member and the second tube member is positioned within the first tube member and is adapted and configured for supplying fuel to the fuel inlet of the adapter member.

It is envisioned that the nozzle assembly of the present invention can also include an air shroud positioned over the air cap, so as to define a second air circuit between the air shroud and air cap. In a preferred embodiment, system air or fan air is supplied to the second air circuit.

It is presently preferred that the nozzle assembly be capable of accommodating a fuel flow modulation turn down ratio of 5. Preferably, the nozzle assembly is adapted and configured for fuel flow modulation between 0.1 gallons per hour and 0.5 gallons per hour.

The present invention is also directed to an air-assisted spray nozzle assembly that includes, inter alia, an elongated nozzle body, an orifice disc, a fuel distributor, an adapter member and an air cap.

The elongated nozzle body has a peripheral wall that extends between axially opposed upstream and downstream ends. Moreover, the nozzle body defines an interior chamber for the spray nozzle assembly and has a plurality of air passages formed in its peripheral wall which extend radially outward from the interior chamber. In certain constructions, the nozzle body includes a plurality of radial flow ports.

The orifice disc is disposed within the interior chamber of the nozzle body, adjacent the downstream end thereof. A fuel orifice extends from an upstream side of the orifice disc to a downstream side of the disc.

The fuel distributor is disposed within the interior chamber of the nozzle body and is positioned adjacent to and upstream of the orifice disc. The fuel distributor defines a fuel passage which extends axially from its upstream end to a plurality of radially oriented exit ports. In certain embodiments, it is envisioned that a fuel circuit extends through a gap formed between the fuel distributor and the orifice disc. Preferably, the fuel distributor has a plurality of slots formed in its downstream end that are adapted and configured for imparting a swirl to the fuel. In certain embodiments, the slots are formed in planes that are slightly offset from a plane passing through the central axis of the distributor. In alternative embodiments the slots can be formed in arcs similar to swirling vanes.

The adapter member is releasably secured to the upstream end of the nozzle body so as to retain the orifice disc and fuel distributor within the interior chamber. The adapter member defines a fuel inlet passage and an assist air inlet passage for the spray nozzle. The fuel inlet passage extends axially through the adapter member and connects with the fuel passage of the distributor. The air inlet passage extends axially from the upstream end of the adapter to a plurality of flow ports which are formed at an angle with respect to the axis for the spray nozzle and exit the periphery of the adapter member.

The air cap is positioned over the downstream end of the nozzle body for directing the assist air received from the air inlet passage of the adapter member to the fuel orifice of the orifice disc where the assist air merges with the fuel. In a preferred construction, the assist air is provided to the air inlet passage of the adapter member by an auxiliary pump.

It is also envisioned that the downstream surface of the nozzle body includes structure (e.g., vane elements) for imparting a swirling motion to assist air passing through a gap defined between the air cap and the nozzle body.

In certain embodiments of the present invention the nozzle assembly can also include a first and second tube members that are engaged with the adapter member. It is envisioned that the first tube member is adapted for supplying assist air to the air inlet of the adapter member and the second tube member is positioned within the first tube member and is adapted and configured for supplying fuel to the fuel inlet of the adapter member.

It is envisioned that the nozzle assembly of the present invention can also include an air shroud positioned over the air cap, so as to define a second air circuit between the air shroud and air cap. Preferably, the air supplied to the second air circuit is provided by a blower or motor/fan assembly.

In a presently preferred embodiment of the present invention the nozzle assembly including an air shroud is capable of accommodating a fuel flow modulation turn down ratio of 5. Preferably, the nozzle assembly including air shroud is adapted and configured for fuel flow modulation between 0.1 gallons per hour and 0.5 gallons per hour.

The present invention is also directed to an oil burner for home heating that includes, among other elements, an air pump or compressor for providing assist air, a motor driven blower for providing system air, a fuel pump for supplying fuel and an air assisted spray nozzle that has been constructed in accordance with the teachings of the present invention.

BRIEF DESCRIPTION OF THE DRAWINGS

So that those having ordinary skill in the art will better understand how to make and use the nozzles of the subject invention, embodiments thereof will be described below with reference to the drawings wherein.

These and other aspects of the subject invention will become more readily apparent to those having ordinary skill in the art from the following detailed description of the preferred embodiments of the invention taken in conjunction with the figures.

DETAILED DESCRIPTION OF THE PREFERRED EMBODIMENTS

Figure 1A:
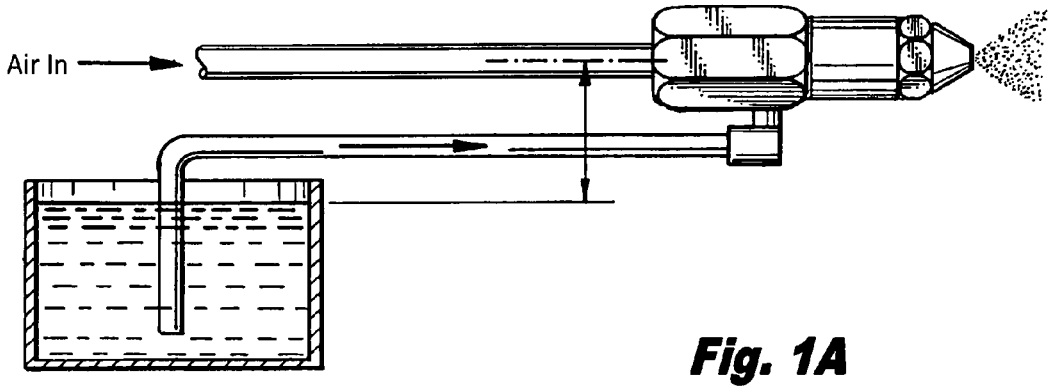
Fig. 1A (Prior Art)
FIG. 1*a* is an elevational view of a prior art system for atomizing fuel.
Figure 1B:
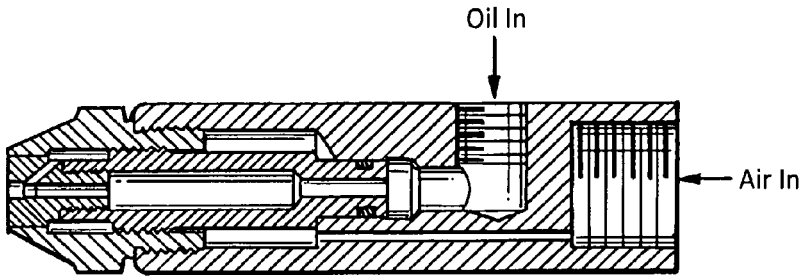
Fig. 1B (Prior Art)
FIG. 1*b* provides an elevational view (taken in cross-section) and upstream and downstream end views of a siphon nozzle used in the prior art system shown in FIG. 1*a;*
Figure 2A:
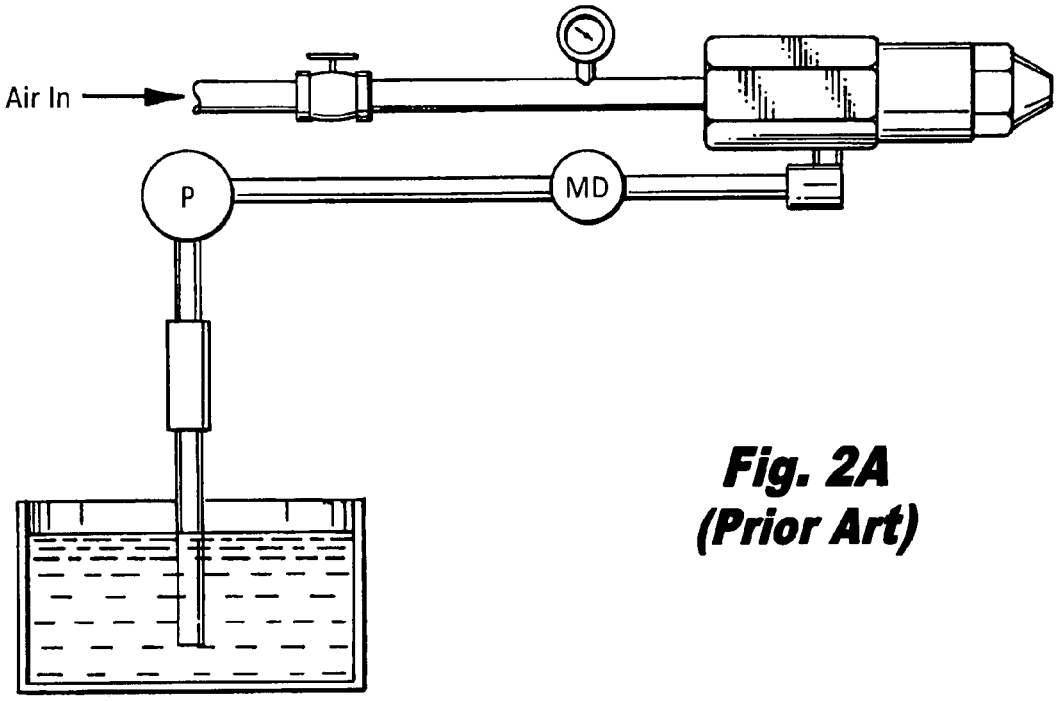
Fig. 2A (Prior Art)
FIG. 2*a* is an elevational view of a second prior art system for atomizing fuel.
Figure 2B:
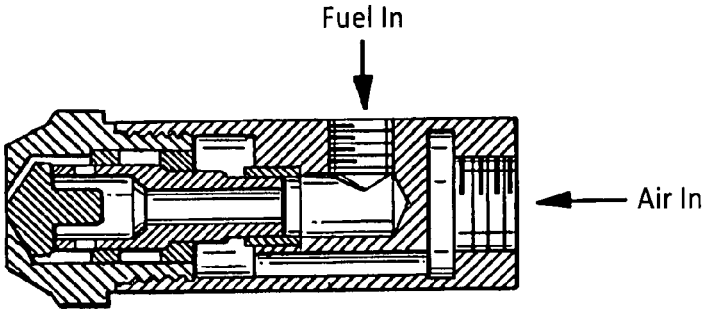
Fig. 2B (Prior Art)
FIG. 2*b* provides an elevational view (taken in cross-section) and upstream and downstream end views of an Airo nozzle.
Figure 3:
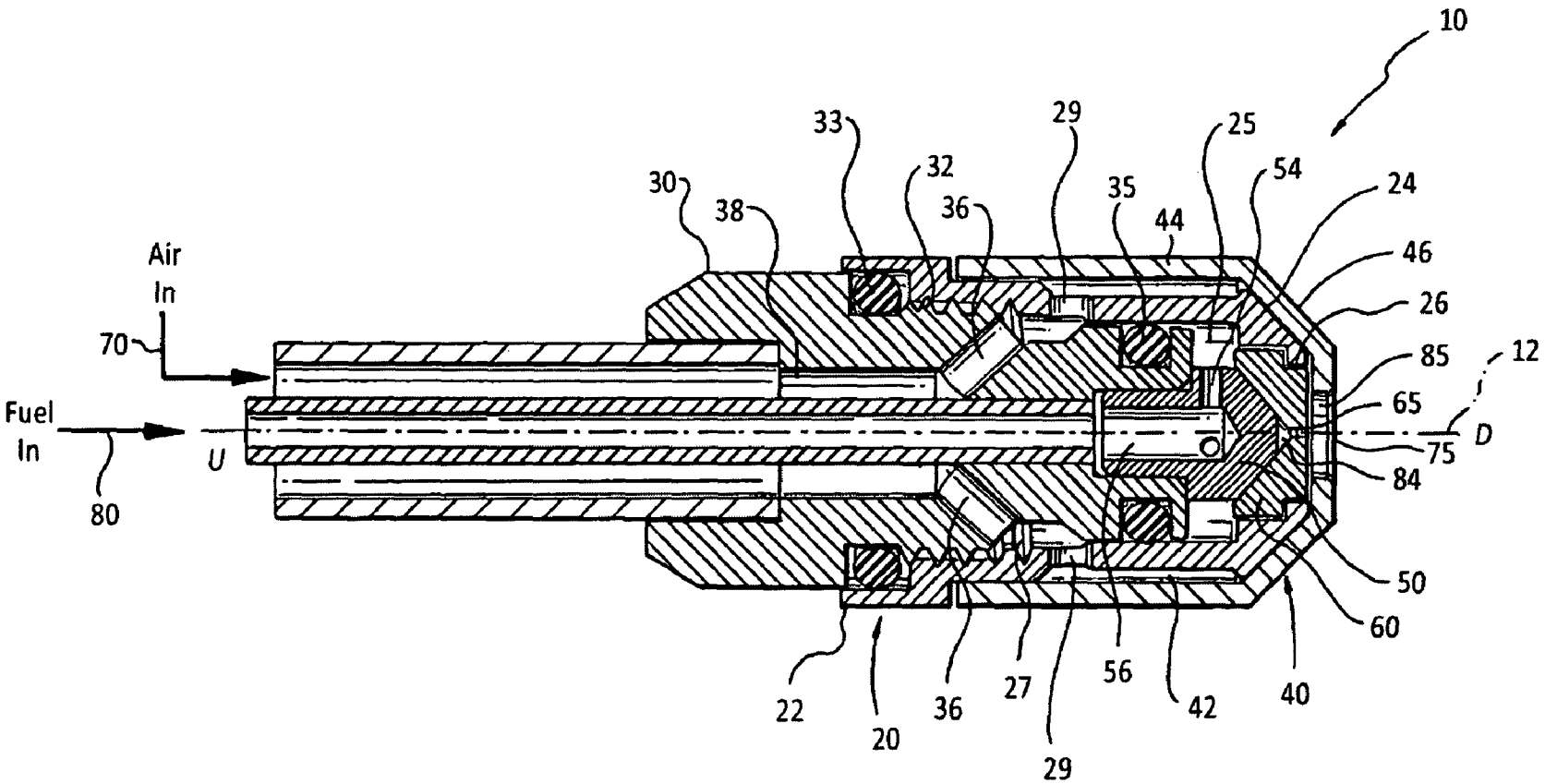
FIG. 3 is side elevational view taken in cross-section of an air-assisted fuel nozzle which has been constructed in accordance with a preferred embodiment of the present invention.

In the description which follows, as is common in the art to which the subject invention appertains, the term "upstream" shall refer to a direction with respect to the air-assisted nozzle that faces the fuel and air inlet/supply, while the term "downstream" shall refer to a direction with respect to the air-assisted nozzle that faces the fuel and air exit, as identified in FIG. 3 by reference characters U and D.

Figure 4:
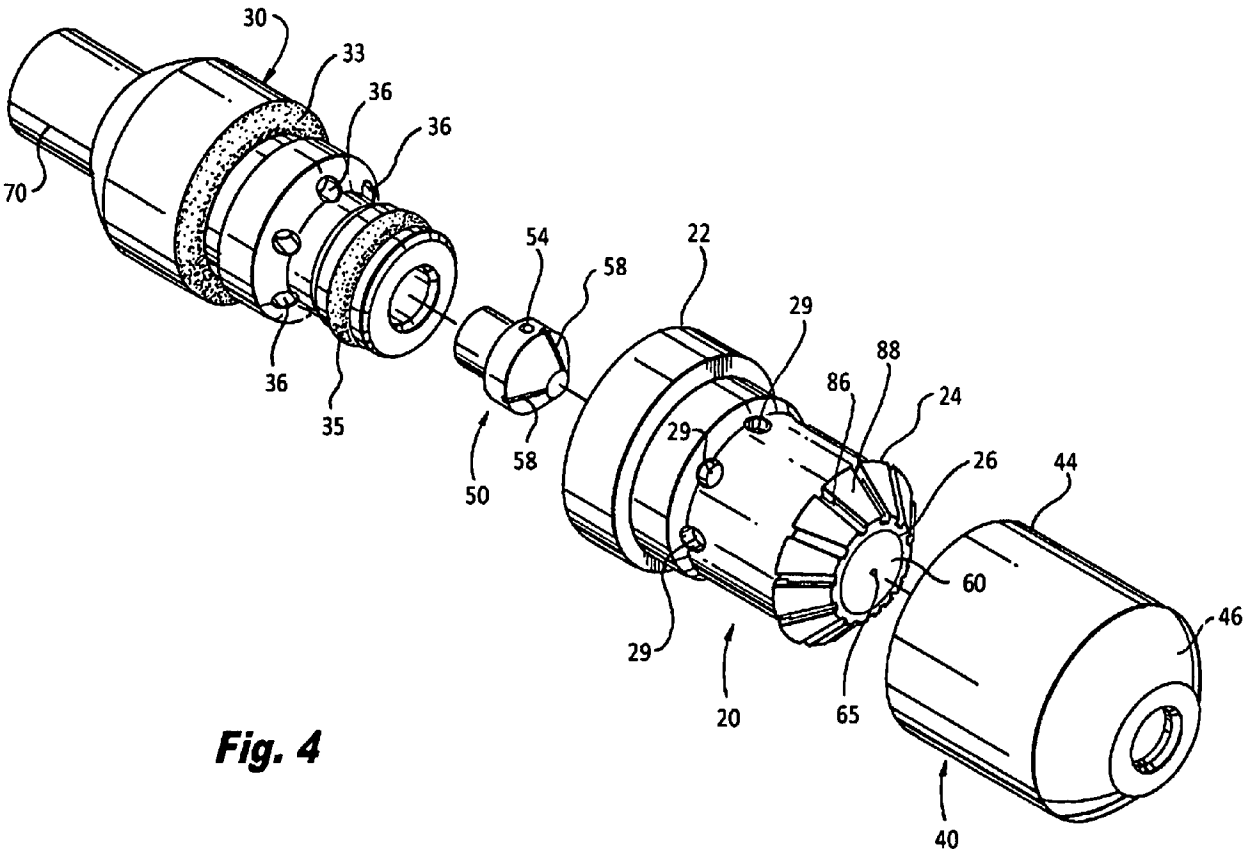
FIG. 4 is an exploded perspective view of the nozzle of FIG. 3.

Referring now to the drawings wherein like reference numerals identify similar features of the nozzle of the subject invention, there is illustrated in FIGS. 3 and 4, an air-assisted fuel nozzle constructed in accordance with a preferred embodiment of the subject invention and designated generally by reference numeral 10. Nozzle 10 includes a nozzle body 20 that has opposed upstream and downstream ends 22/24, respectively. The nozzle body 20 also defines an interior chamber 25 which terminates in a aperture 26 associated with the downstream end 24 of the nozzle.

An adapter member 30 is engaged with the upstream end 22 of the nozzle body 20 and includes a series of male threads 32 that engage with corresponding female threads 27 formed on the nozzle body 20. A pair of 0-rings 33/35 are used to seal the connection between the adapter member 30 and the nozzle body 20, so as to prevent fluid and air leakage. Those skilled in the art will readily appreciate that a variety of connections can be used to releasably secure the adapter member 30 to the nozzle body 20 without departing from the inventive aspects of the present disclosure.

The adapter member 30 also includes a plurality of flow ports 36 that are in fluid communication with an air inlet 38 and extend at an angle with respect to a central axis 12 for the nozzle 10. The nozzle body 20 includes a plurality of circumferentially spaced apart flow ports 29 that are in fluid communication with corresponding flow ports 36 of the adapter member 30.

An air cap 40 is positioned over the downstream end 24 of the nozzle body 20. The air cap 40 has an outer circumferential wall 44 with an inner diameter that is dimensioned for insertion over a portion of the upstream end 22 of the nozzle body 20. The air cap 40 also includes an inwardly projecting frustoconical surface 46 that encloses the downstream end 24 of the nozzle body 20.

A fuel distributor 50 and an orifice disc 60 are disposed within the interior chamber 25 of the nozzle body 20. The fuel distributor 50 receives fuel from the fuel inlet of the nozzle 10 and directs the fuel radially outward through a plurality of exit ports 54.

First and second tube members 70/80 are engaged with the upstream end of the adapter member 30. As will be discussed in more detail below, the first tube member 70 receives auxiliary assist air and supplies the assist air to the air inlet 38 of the adapter member 30. The second tube member 80 is coaxially positioned within the first tube member 70 and is adapted and configured for receiving fuel from a fuel pump and directs the fuel to the adapter member 30.

The assembled nozzle 10 defines a fuel circuit and a first air circuit. In operation, the second tube member 80 of the nozzle assembly is fluidly connected to a fuel source. The second tube member 80 or fuel supply tube receives the fuel and directs it axially to an inlet port 56 formed in the distributor 50. The distributor 50 redirects the fuel radially outward through flow ports 54 into a void space formed within interior chamber 25. The distributor 50 has a series of flow channels 58 formed on its downstream surface which allow the fuel to proceed between the distributor 50 and the orifice disc 60 into spin chamber 80. As shown in FIG. 4, flow channels 58 are formed in a plane that is slightly offset from a plane that extends through the central axis of the distributor. This offset configuration of the flow channels 58 causes the fuel to swirl when it enters spin chamber 80. When viewing the distributor 50 in the upstream direction, the flow channels 58 are formed such that the fuel will spin in the clockwise direction. The swirling fuel then proceeds through an exit orifice 65 formed in the orifice disc 60 into a mixing chamber 85 where it is merged with the assist air and exits the downstream end of nozzle body 20 through a central fuel outlet 75.

The first tube member 70 (air supply tube) receives assist air from an auxiliary pump, for example, and directs the air towards the air inlet 38 of the adapter member 30. The assist air then proceeds through flow ports 36 and 29 of the adapter member 30 and nozzle body 20, respectively. The nozzle body 20 has a plurality of flow channels 86 formed on its downstream end 24 that are defined by a plurality of vane elements 88. The assist air flows from within gap 42, through the flow channels 86, which impart a swirling motion to the air, and then the swirling air merges with the fuel exiting orifice 65 in mixing chamber 85. In the embodiment shown in FIG. 4, when viewing the nozzle body 20 in the upstream direction, the flow channels 86 are formed such that they impart a clockwise spin to the assist air and thus, the air and fuel are co-rotating.

In home heating applications, the auxiliary assist air is provided to the first air circuit and the air supply tube at a pressure that is considered relatively high compared to the pressure of the system air provided by a blower assembly that includes a motor and a fan. For example, the presently disclosed nozzle performed well during testing when the auxiliary pump provided assist air at about between 2 psig to about 4 psig and the blower assembly provided system air to the nozzle at between about 5 inches to 10 inches of water delta pressure (0.1805 psig to 0.3610 psig).

Nozzle 10 is adapted for use in home heating applications that require a particularly low fuel flow rate. For example, in small homes or offices, it is desirable to provide the fuel at an extremely low flow rate (i.e., less than 0.5 gallons per hour). Traditionally, such low flow rates have not been achievable due to the inability to provide a fuel nozzle that can support a flow rate below 0.5 GPH without clogging.

Nozzle 10 is capable of accommodating a fuel flow modulation turn down ratio of 5 and is adapted and configured for fuel flow modulation between about 0.1 gallons per hour and about 0.5 gallons per hour. At very low flow rates, such as 0.1 GPH, the distributor is ineffective and the fuel exits orifice 65 with very little momentum. The air assist circuit picks up the fuel as it exits and creates the desired conic spray. At higher fuel flow rates (e.g. 0.5 GPH) the distributor imparts a swirling motion that causes the fuel to spread out into a conic spray or an onion shape as it exits orifice 65. The fuel spray is again merged with the assist air and creates the desired conic spray. The use of a distributor 50 with angled flow channel 58 imparts a swirling motion on the fuel and avoids the narrow spray angle of a plain orifice.

Figure 5:
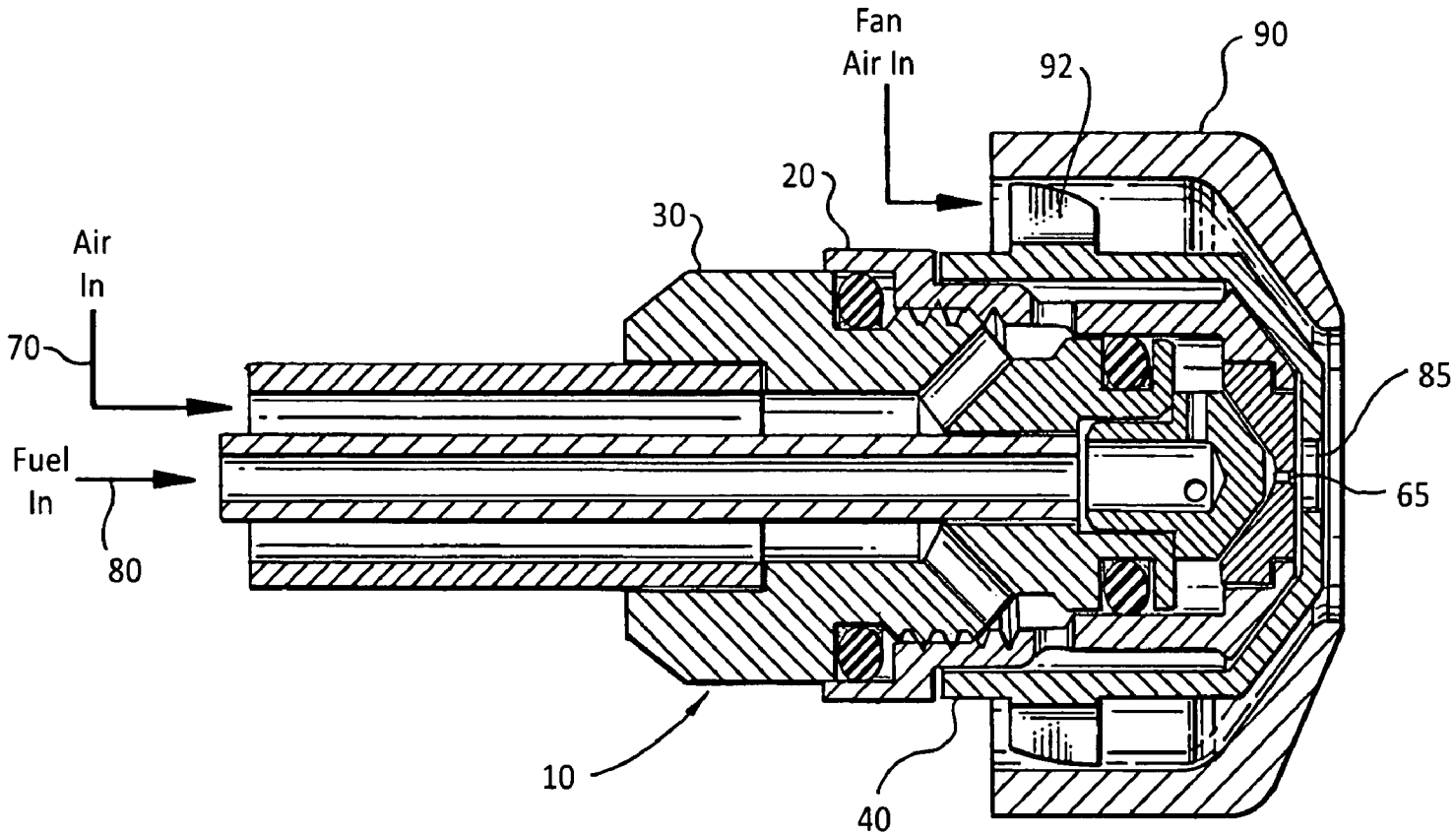
FIG. 5 is a side elevational view taken in cross-section of a second embodiment of the air-assisted fuel nozzle of the present invention.

The assist air circuit is positioned concentrically outboard of the fuel exit orifice. If additional air is required for process mixing or for combustion, additional swirlers can be added concentrically outboard of the air assist circuit. FIG. 5 provides an example of how such a nozzle can be constructed. As shown therein, a shroud 90 or air swirler is positioned over the downstream end of air cap 40 and nozzle body 20. Shroud 90 includes a plurality of vane elements 92 which impart a swirling motion to the fan or system air that has been directed toward the shroud 90. These vane elements can be constructed such that they counter rotate the system air with respect to the assist air and fuel or co-rotate the air depending on the operational parameters of the system. The additional system air is merged with the conical fuel/air spray that is exiting mixing chamber 85 and aids in further shaping the spray.

Figure 6:
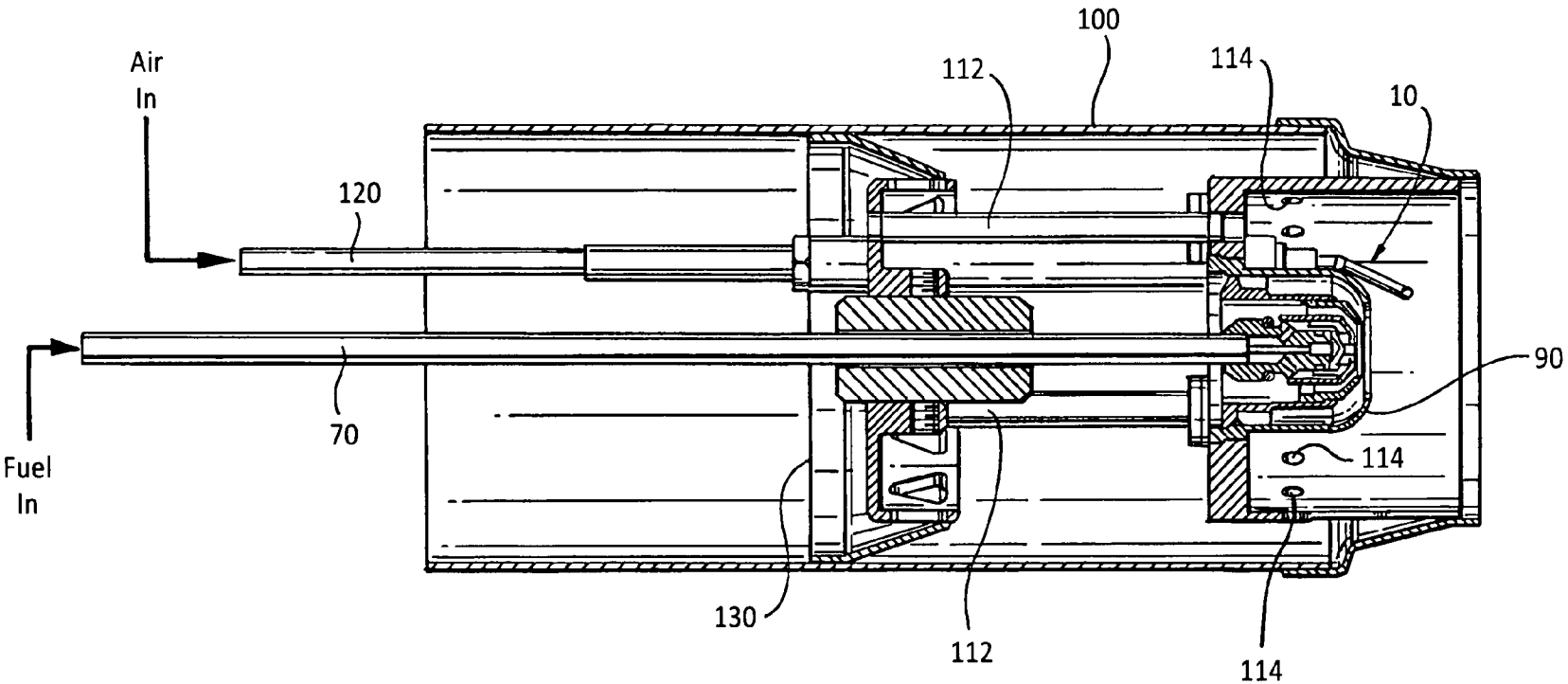
FIG. 6 is a side elevational view taken in cross-section of an air-assisted fuel nozzle that has been constructed in accordance with the present invention and shown installed within an air tube and flame retention sleeve.

Referring now to FIG. 6, which shows nozzle 10 with an external shroud 90 installed within a NX tube assembly 100. Nozzle 10 is mounted to a flame retention sleeve 110 that is held within tube assembly 100 using supports 112. The flame retention sleeve 110 includes air ports 114 for directing additional air to the combustion region. The tube assembly further includes an air gate 130 which allows air to be ported into the space defined between the air gate 130 and the flame retention sleeve 110. As discussed in detail in U.S. Pat. No. 6,382,959 to Turk et al., which is hereby incorporated by reference in its entirety, the distance between the air gate 130 and the flame retention sleeve 110 can be selectively adjusted in order to modulate the air flow and pressure within the burner system. Lastly, an ignition assembly 120 is also provided for igniting the fuel/air mixture.

Since the mixing of the fuel and assist air occurs external to the nozzle body, there is little feedback between the fuel and the air assist circuits. As a result, the fuel can be modulated without impacting the flow of the assist air and vice verse. Through experimentation, nozzle 10 performs optimally when the assist air pressure is between about 2 and about 4 psig for fuel flow rates of 0.1 to 0.6 GPH.

Figure 7:
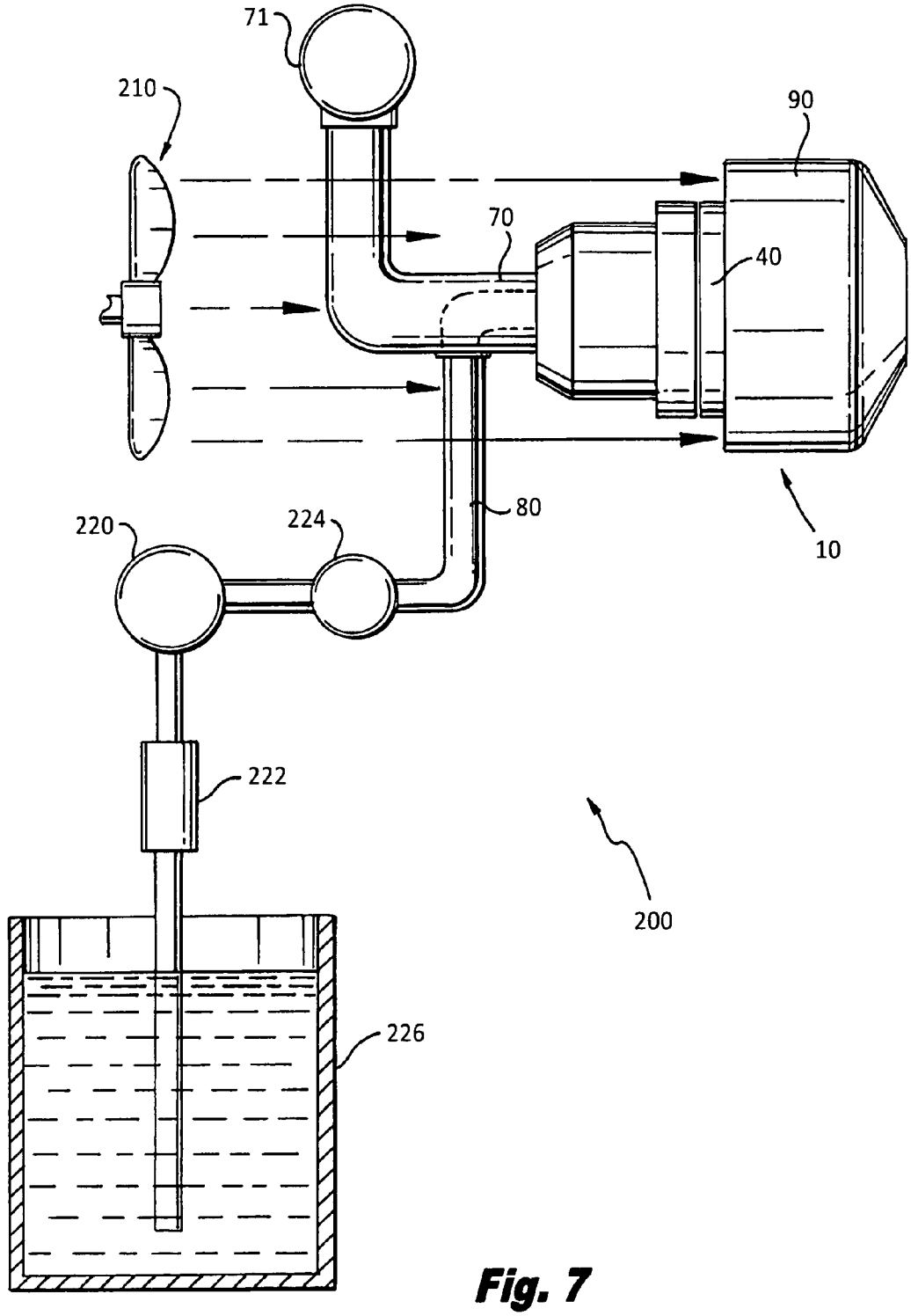
FIG. 7. is an elevational view of a burner system that includes a blower driven motor, a fuel pump and a spray nozzle assembly that has been constructed in accordance with the teachings of the present disclosure.

FIG. 7 provides a schematic representation of an oil burner system for home heating applications that has been designated generally by reference numeral 200. In system 200, a fuel pump 220 draws fuel from fuel tank 226 and supplies low pressure fuel through a filter 222 and a meeting device 224 to the fuel supply tube member 80 of nozzle 10. Auxiliary pump 71 provides relatively high pressure, high velocity assist air to the first tube member 70 of nozzle 10. The fuel and assist air traverse nozzle 10 through the fuel and air circuits that were previously discussed above. In extremely low flow applications (e.g., fuel flow less than 0.5 GPH), the fuel exits the discharge orifice with very little momentum where it is merged with the assist air. The assist air picks up the fuel and creates the desired conic spray of finely atomized fuel. If additional air is required for process mixing for combustion or for shaping, a motor driven blower 210 provides system air to nozzle 10 as previously described.

While the present invention has been described in terms of specific embodiments thereof, it will be understood that no limitations are intended thereby to the details of construction or design, the present invention contemplating and including any novel feature or novel combination of features which are herein disclosed.

What is claimed is:

1. An air-assisted spray nozzle assembly for a fuel burner comprising:

a) a nozzle body defining a central axis and having opposed upstream and downstream ends, the downstream end of the nozzle body defining a central fuel outlet;

b) an adapter member engaged with the upstream end of the nozzle body and defining coaxially positioned air and fuel inlets for the nozzle assembly;

c) an air cap positioned over the downstream end of the nozzle body;

d) a fuel circuit for directing fuel from a fuel pump toward the central fuel outlet of the nozzle body, the fuel circuit extending from the fuel inlet of the adapter member through the nozzle body to the central fuel outlet of the nozzle body;

e) a first air circuit for directing assist air towards fuel exiting from the central fuel outlet of the nozzle body, the first air circuit extending from the air inlet of the adapter member, through a plurality of circumferentially spaced apart radial flow ports formed in the nozzle body, to a radially outer circumferential air gap defined between the air cap and the nozzle body, the circumferential air gap communicating with a central mixing chamber defined by the air cap in which assist air flowing from the first air circuit merges with fuel emitted from the central fuel outlet of the nozzle body f) a fuel distributor disposed within an interior chamber defined by the nozzle body for receiving fuel from the fuel inlet of the adapter member and directing the fuel radially outward; and g) an orifice disc disposed within the interior chamber of the nozzle body downstream of the fuel distributor, wherein the fuel circuit extends through a gap formed between the fuel distributor and the orifice disc to a spin chamber communicating with the central fuel outlet of the nozzle body.

2. The air-assisted spray nozzle assembly as recited in claim 1, wherein the assist air is provided to the first air circuit by an auxiliary pump.

3. The air-assisted spray nozzle assembly as recited in claim 1, wherein the fuel distributor has a plurality of slots formed in a downstream end surface thereof that are adapted and configured to impart a swirl to fuel passing therethrough.

4. The air-assisted spray nozzle assembly as recited in claim 1, wherein the adapter member includes a plurality of circumferentially spaced apart flow ports in fluid communication with the air inlet of the adapter member and extending at an angle with respect to the central axis of the nozzle assembly to the exterior of the adapter member.

5. The air-assisted spray nozzle assembly as recited in claim 4, wherein the radial flow ports formed in nozzle body are in fluid communication with the flow ports of the adapter member.

6. The air-assisted spray nozzle assembly as recited in claim 1, wherein a downstream surface of the nozzle body includes a plurality of flow channels for imparting a swirling motion to assist air passing from the circumferential air gap defined between the air cap and the nozzle body to the central mixing chamber.

7. The air assisted spray nozzle assembly as recited in claim 1, further comprising a first tube member engaged with the adapter member for supplying assist air to the air inlet of the adapter member.

8. The air assisted spray nozzle assembly as recited in claim 7, further comprising a second tube member positioned within the first tube member and engaged with the adapter member for supplying fuel to the fuel inlet of the adapter member.

9. The air assisted spray nozzle assembly as recited in claim 1, further comprising an air shroud positioned over the air cap so as to define a second air circuit between the air shroud and air cap for directing air toward fuel exiting the central mixing chamber.

10. The air assisted spray nozzle assembly as recited in claim 1, wherein the nozzle assembly can accommodate a fuel flow modulation turn down ratio of 5.

11. The air assisted spray nozzle assembly as recited in claim 10, wherein the nozzle assembly is adapted and configured for fuel flow modulation between 0.1 gallons per hour and 0.5 gallons per hour.

12. An air-assisted spray nozzle assembly comprising:

a) an elongated nozzle body defining a central axis and having a peripheral wall that extends between axially opposed upstream and downstream ends, the nozzle body defining an interior chamber for the spray nozzle assembly and having a plurality of air passages formed in the peripheral wall thereof which extend radially outward from the interior chamber;

b) an orifice disc disposed within the interior chamber of the nozzle body adjacent the downstream end thereof, the orifice disc having a central fuel orifice extending from an upstream side of the orifice disc to a downstream side of the orifice disc;

c) a fuel distributor disposed within the interior chamber of the nozzle body and positioned adjacent to and upstream of the orifice disc, the fuel distributor defining a central fuel passage which extends axially from an upstream end thereof to a plurality of radially oriented exit ports;

d) an adapter member releasably secured to the upstream end of the nozzle body so as to retain the orifice disc and fuel distributor within the interior chamber of the nozzle body, the adapter member defining a fuel inlet passage and an assist air inlet passage for the spray nozzle, the fuel inlet passage extending axially through the adapter member and communicating with the central fuel passage of the distributor, the air inlet passage extending axially from the upstream end of the adapter to a plurality of flow ports formed at an angle with respect to the central axis of the spray nozzle and exiting the periphery of the adapter member; and e) an air cap positioned over the downstream end of the nozzle body for directing assist air received from the flow ports of the adapter member to the central fuel orifice of the orifice disc where assist air can merge with fuel exiting from the central fuel orifice within a mixing chamber defined by the air cap.

13. The air-assisted spray nozzle assembly as recited in claim 12, wherein the assist air is provided to the air inlet passage of the adapter member by an auxiliary pump.

14. The air-assisted spray nozzle assembly as recited in claim 12, wherein a fuel circuit extends through a gap formed between a downstream end surface of the fuel distributor and the upstream side of the orifice disc.

15. The air-assisted spray nozzle assembly as recited in claim 12, wherein the fuel distributor has a plurality of slots formed in a downstream end surface thereof that are adapted and configured to impart a swirl to the fuel.

16. The air-assisted spray nozzle assembly as recited in claim 12, wherein the air passages in the peripheral wall of the nozzle body are in fluid communication with the flow ports of the adapter member and are configured to direct assist air to a circumferential air gap defined between the air cap and nozzle body.

17. The air-assisted spray nozzle assembly as recited in claim 16, wherein a downstream surface of the nozzle body includes a plurality of flow channels for imparting a swirling motion to assist air passing through the circumferential air gap defined between the air cap and the nozzle body.

18. The air assisted spray nozzle assembly as recited in claim 12, further comprising a first tube member engaged with the adapter member for supplying assist air to the air inlet passage of the adapter member.

19. The air assisted spray nozzle assembly as recited in claim 18, further comprising a second tube member positioned coaxially within the first tube member and engaged with the adapter member for supplying fuel to the fuel inlet passage of the adapter member.

20. The air assisted spray nozzle assembly as recited in claim 12, further comprising an air shroud positioned over the air cap so as to define a second air circuit between the air shroud and the air cap for directing air toward fuel exiting the central mixing chamber.

* * * * *